United States Patent [19]

Muylle

[11] Patent Number: 4,480,742

[45] Date of Patent: Nov. 6, 1984

[54] METHOD AND APPARATUS FOR CONVEYING AND SPREADING MATERIAL

[75] Inventor: Wilfried E. Muylle, Schoten, Belgium

[73] Assignee: AGFA-GEVAERT N.V., Mortsel, Belgium

[21] Appl. No.: 391,671

[22] Filed: Jun. 24, 1982

[30] Foreign Application Priority Data

Jul. 2, 1981 [GB] United Kingdom ..... 8120443

[51] Int. Cl.[3] ..... B65H 35/02; B65G 47/08; B65G 17/02

[52] U.S. Cl. ..... 198/689; 198/458; 271/299; 271/197; 38/143

[58] Field of Search ..... 271/194, 196, 197, 198, 271/283, 299, 302; 198/689, 811, 458; 38/102, 143

[56] References Cited

U.S. PATENT DOCUMENTS

| | | | |
|---|---|---|---|
| 3,477,558 | 11/1969 | Fleishauer | 271/197 |
| 3,553,861 | 1/1971 | Orkney et al. | 38/143 |
| 3,809,207 | 5/1974 | Enverard | 198/458 |

FOREIGN PATENT DOCUMENTS

| | | | |
|---|---|---|---|
| 1302783 | 1/1973 | United Kingdom | 198/458 |
| 2032377 | 5/1980 | United Kingdom | 198/458 |

*Primary Examiner*—Bruce H. Stoner, Jr.
*Assistant Examiner*—James E. Barlow
*Attorney, Agent, or Firm*—William J. Daniel

[57] ABSTRACT

A spreading conveyor comprising an endless air-permeable laterally stretchable spreading band, endless air-permeable supporting band means within the path of the spreading band, and a suction box within the loop of the suction band and having a perforated wall in contact with the inner side of the supporting band means along a portion of its path. This arrangement allows a reduction in the wear and deformation of the spreading band, and can operate at higher speeds than common spreading bands that operate without suction means.

7 Claims, 3 Drawing Figures

METHOD AND APPARATUS FOR CONVEYING AND SPREADING MATERIAL

Figure 1:
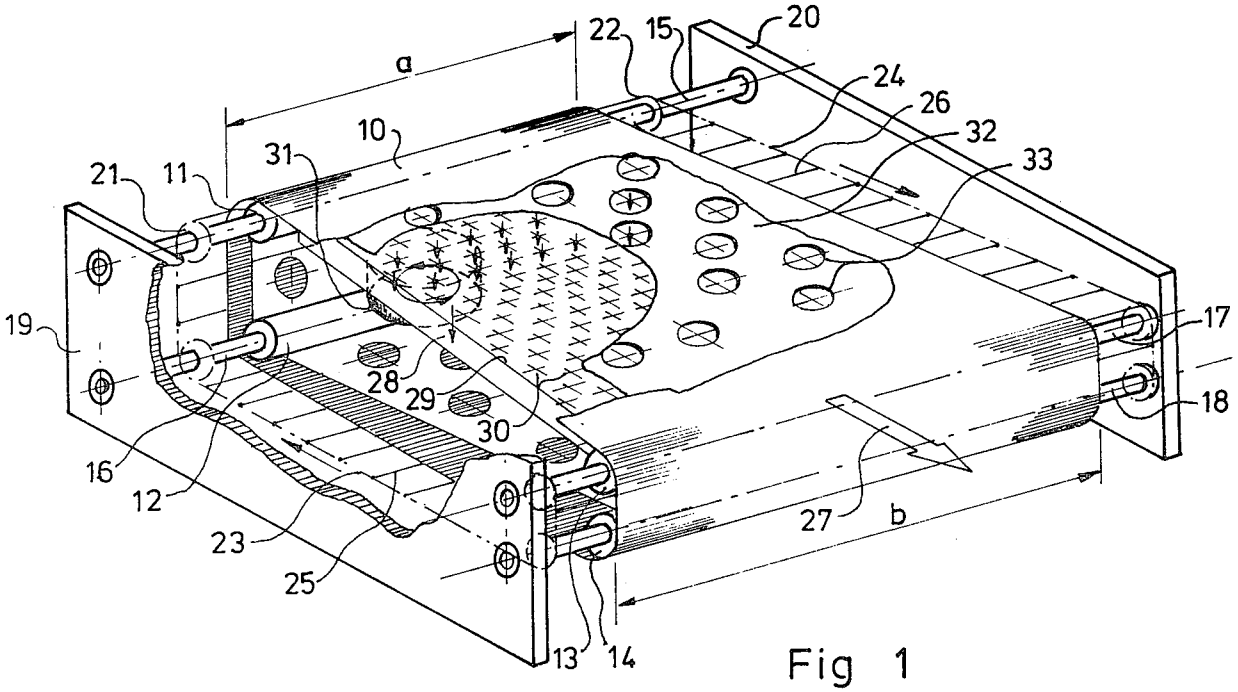

The present invention relates to a method and apparatus of conveying material and spreading it during its conveyance, in which method the material is fed onto one reach (hereafter called "conveying reach") of an endless conveyor which is elastically extensible in its widthwise direction and successive portions along which are progressively stretched laterally during travel along the conveying reach thereby to cause spreading or separation of discrete units of material laterally of their direction of conveyance. The invention also relates to a spreader-conveyor for use in performing such method.

Such spreader-conveyors are used, for example, for advancing rows of juxtaposed sheets from a preceding conveyor on which they are formed by longitudinally and transversely cutting a web, to a stacking station where the sheets are arranged into stacks. The automatic lateral spreading of the sheets in each row has the effect that streams of sheets are simultaneously delivered to a number of laterally spaced stacking locations.

For some purposes the known spreader-conveyors do not exercise sufficient control over the displacement of material loaded onto them. For example when loaded with juxtaposed sheets of paper or cardboard the sheets tend to become haphazardly misplaced by air friction even at quite slow conveyor speeds. The maximum speed at which such a conveyor can be operated depends on the thickness and weight of the sheet material being handled and its inherent flatness and flexibility. When handling sheets of paper or cardboard that are not very flat, or very flexible sheets, e.g. sheets of paper weighing less than 60 $g.m^{-2}$ the conveyor usually cannot be operated above about 40 $m.min^{-1}$.

The object of the present invention is to achieve better control of material during conveyance and spreading thereof.

In accordance with the present invention, a method of conveying material and spreading it during its conveyance, in which method the material is fed onto one reach (hereinafter called "conveying reach") of an endless conveyor which is elastically extensible in its widthwise direction and successive portions along which are progressively stretched laterally during travel along the conveying reach thereby to cause spreading separation of the material laterally of its direction of conveyance, is characterised thereby that the conveyor is air-permeable and its conveying reach is supported by one reach of an endless air-permeable support means which is advanced in the same direction as the elastic conveyor, but is not stretched during its rotation, and in that the conveying reach of the elastic conveyor is exposed through the support to sub-atmospheric pressure which increases the contact pressure between the material and conveyor.

In a method according to the invention the existance of the reduced pressure beneath the elastic conveying reach of the conveyor has the effect of increasing the contact pressure of the conveyed material on the conveyor. In consequence there is less risk of the material undergoing displacement other than those which are intended and which are attributable to the movement of the conveyor and the transverse stretching of its conveying reach. This result is achieved without subjecting the conveyor to frictional wear such as would occur if the conveying reach were itself to run in contact with a suction head of a vacuum line. There is no difficulty in constructing the endless rotating support means with sufficient wear resistance when it does not have to possess the elastic extensibility necessary for the conveyor. The support means can be in the form of one endless air-permeable band of uniform width or in the form of a plurality of laterally spaced bands of small, and uniform width. Moreover if the elastic conveyor were itself to run in contact with a suction head, the conveying reach, being relatively easily extensible, would be liable to undergo deformation because the contact with the suction head would tend to cause the central portion of that reach to lag with respect to its margins. Such deformation would be liable to cause wrinkles in the material carried on the conveyor that might interfere with its correct movement.

The material of the conveyor may be progressively widthwise stretched over the full length of the conveying reach or over only part of that length.

For the most effective control over the displacement of the conveyed material it is self-evident that the conveying reach of the elastic conveyor should be exposed to the sub-atmospheric pressure over as much of its length as possible. In practice this means that the low pressure zone preferably extends over substantially the whole of the available distance between the reversing rollers over which the conveyor travels at the ends of the conveying reach. However, the invention affords advantages even if the length of the low pressure zone is less. For example, taking into account that the action of the reduced pressure is particularly beneficial at any location where the conveyor is in course of being laterally stretched, then in the event that stretching occurs over only a part of the length of the conveying reach, the low pressure zone can substantially coincide with that stretch zone.

The invention is primrily intended for use in conveying and spreading separate articles, particularly sheets. A very important field of use of the invention is the conveyance and lateral spreading of juxtaposed sheets formed by longitudinally and transversely cutting a web as it is fed towards the spreader-conveyor. However, the invention can be employed for spreading material composing a single article. For example the method can be employed for laterally spreading material of a sheet or web in order to remove wrinkles.

Preferably the linear speeds of the elastic conveyor and the support means are equal to each other or substantially so. In these circumstances relative sliding contact between the conveyor and the support means occurs substantially only transversely of the direction of conveyor travel.

The elastic conveyor and the endless support means can be mounted on common rotatable carriers and be advanced via a common drive. Preferably however they are independently mounted and there is provided means for adjusting their relative speed. It can then be more easily ensured that the linear speeds of the conveyor and support means are equal.

The conveyor is preferably in the form of an endless band or web. As an alternative said conveyor can comprise an endless series of transversely extending elastically extensible strips or other elements.

The invention includes a spreader-conveyor suitable for use in carrying out the method hereinbefore defined.

According to the invention, a conveyor for conveying and spreading material placed thereon having an endless conveying means which is elastically extensible in its widthwise direction and is connected to opposed driving mechanisms along its side edges which diverge in one lengthwise direction of the conveyor so as to cause successive portions along the conveying means to be progressively widthwise stretched during travel of one reach (hereinafter called "the conveying reach" of the conveyor), is characterized in that said conveying means is air-permeable, that beneath said conveying reach there is a suction head of a vacuum system for maintaining a sub-atmospheric pressure zone effective for drawing conveyed material against the conveying reach, and that within the loop formed by endless conveying means there is an endless rotatable air-permeable inner supporting means which is mounted so that one of its reaches extends between the conveying reach of the endless conveying means and said suction head, and so that it can be advanced simultaneously with conveying means but without being likewise widthwise stretched during its advance.

The endless rotatable inner supporting means of such spreader-conveyor is preferably inextensible under the forces to which it is subjected in operation, which forces include those created by its frictional contact with the suction head and with parts of the elastic conveying means undergoing lateral extension or contraction.

As previously stated, it is preferable for the elastic conveying means and the endless rotatable inner supporting member to be independently mounted. In these circumstances, because the conveying means and the inner means do not contact any common guide roller, they can be driven independently and it is easier to keep their linear speeds equal. Preferably there is means whereby their relative speed can be adjusted so that it can be set and re-set when required, at zero.

Figure 2:
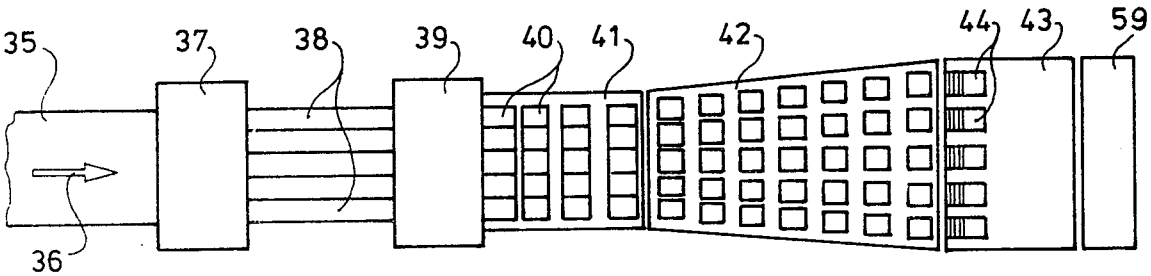
Figure 3:
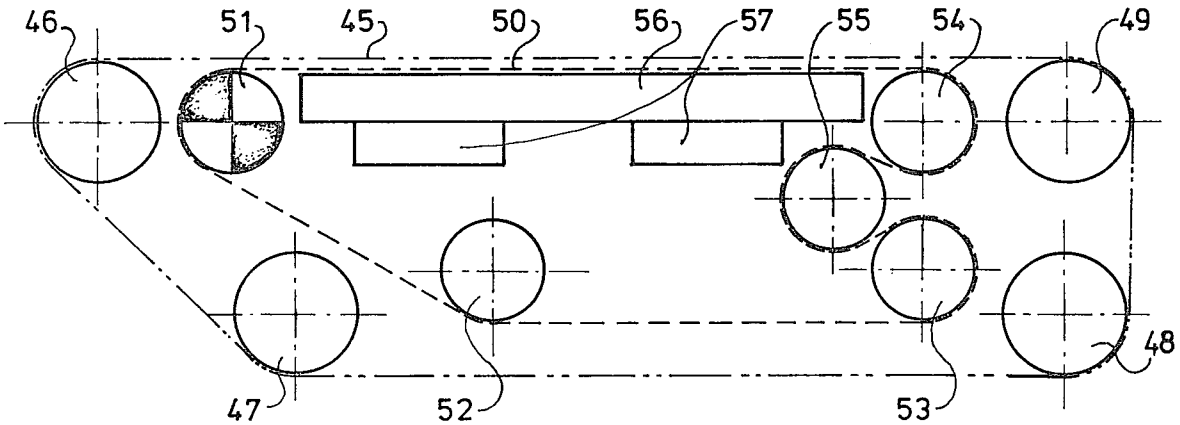

An apparatus according to the invention will be described hereinafter by way of example with reference to the accompanying figures, wherein:

FIG. 1 is a diagrammatic perspective view of a first embodiment of a spreader-conveyor according to the invention, FIG. 2 illustrates the position of a spreader-conveyor in a sheet cutting and stacking installation, FIG. 3 is a diagrammatic longitudinal section of a second embodiment of the invention.

Referring to the spreader-conveyor illustrated in FIG. 1, an elastic air-permeable endless conveyor 10 in the form of an air-permeable band is guided over four prallel rollers 11, 12, 13 and 14 that are mounted for free rotation on shafts 15, 16, 17 and 18. A suitable material for the band is jersey cloth, that is a plain weft-knitted fabric made from cotton, nylon or other threads. The band can be made from a web of such a fabric, the cut ends of the web being sewn together.

The shafts are rotatably journalled between two parallel side walls 19 and 20. Each shaft is provided with two sprocket wheels, one sprocket wheel near each of its ends such as the sprockets 21 and 22 of the shaft 15. Two endless chain mechanisms 23 and 24 run at either side of the apparatus over the corresponding sprocket wheels. The sprockets on the shafts 17 and 18 are placed nearer to the parallel side walls of the spreader than are the sprockets on the shafts 15 and 16 so that the chain mechanisms follow diverging paths along the upper reach of their travel, for a chain advance as shown by the corresponding arrows.

The opposed edges of the conveying band 10 are connected by a plurality of rigid links 25 and 26 to the corresponding chain mechanisms 23 and 24. Means (not shown) are provided for taking up or counterbalancing the transverse forces acting on the chains. For example the said chains may carry rollers which travel along diverging guide channels.

It will be understood that rotation of the shafts 15 to 18 in a direction so that the upper reach of the band moves in the direction of the arrow 27, i.e. the transport direction of the device, causes a transverse stretching of the band as it moves in that direction as a consequence of the divergence of the chain mechanisms.

The width a of the band at the beginning of the spreading zone is increased to a width b at the end of that zone.

The friction between the band and objects supported thereby is increased as follows. A suction box 28, see the broken away portion at the left side of FIG. 1, is mounted inside the loop of the band 10, with its perforated upper wall 29 closely adjacent to the path of the band 10 between the rollers 11 and 13. The perforations of the wall 29 have been indicated by the plurality of small crosses 30. Subatmospheric pressure in the box 28 may be maintained by means of a plurality of electric fans, such as the fan 31, that are fitted next to each other to the bottom wall of the box 28.

The suction box may have a rectangular upper wall with a width that is equal to or slightly smaller than the width a of the spreading band at the beginning of the spreading zone. Alternatively the suction box can have an upper wall of a trapezium-like shape, with diverging sides as illustrated in the figure.

A second endless and air-permeable band is rotatably arranged within the loop of the first elastic endless band. This second band, called hereinafter the "inner supporting band", is the band 32 revealed in FIG. 1 by the breaking away of a portion of the conveying band 10. The inner band 32 is made from a non-elastic flexible material, such as plastic, metal, a laminate of different materials, etc. The inner band may be made from a plain web which is provided with a plurality of perforations such as the illustrated holes 33. The width of the inner band 32 may be slightly less than the initial width a of the elastic spreading band 10.

The operation of the described spreader-conveyor in an installation for cutting and stacking sheets of web material is illustrated diagrammatically in FIG. 2. A web 35 is transported by means, not shown, in the direction of the arrow 36 at a uniform speed. A web slitter 37 slits the web into a number of (in this example five) strips 38 of smaller width.

A transverse cutter 39, which may be for instance a rotary cross cutter, cuts the bands into individual sheets 40. The sheets, which lie in close edge to edge relationship as they leave the cutter 39, are spread apart from each other in the transport direction by a known mechanism, located at 41, comprising successive rollers or transport belts that are driven at successively increasing speeds.

The sheets 40 are then received on the conveying band 42 of a spreader-conveyor according to the invention whereby the sheets are spread in the transverse direction during their further conveyance. As a consequence of the subatmospheric pressure at the underside of the operative zone of the conveying band, the sheets are firmly urged into contact with the band by the atmospheric pressure, so that the position of the sheets on the band is well under control.

The progressive lateral spreading of the sheets during their advance by the web spreader-conveyor is clearly apparent in FIG. 2. The sheets that are located on the central longitudinal zone of the conveying band move only parallel with the transport direction of the apparatus, whereas the sheets that are located on opposite sides of that zone follow diverging paths. The diverging sheets are not twisted; their edges remain generally parallel with, respectively normal to, the transport direction of the apparatus.

The rows of the spread sheets are collected into stacks 44 by a known mechanism, not illustrated, on the entry end of an endless band 43 while this band is stationary. When the required number of sheets is reached in the stacks, the band 43 is automatically energized for rapid transport of the laterally spaced stacks to a station 59 where the stacks may be removed either manually or automatically. The stacks can then be transferred to a further station, for instance a station for light-tightly wrapping the stacked sheets and inserting each wrapped stack into a paper board box, as in the manufacturing and packaging of NIF (non interleaved) radiographic films in the photographic industry.

Advantages of the illustrated spreader-conveyors are as follows.

Delicate sheets, such as sheets of light-sensitive photographic material, may be spread at high speeds, for instance at speeds up to 120 $m.min^{-1}$ without any risk of damaging the sheets, or loss of their correct positions before reaching the exit end of the conveyor.

The conveying band of the apparatus is not subjected to increased wear as a result of the suction forces because the band does not run in contact with the suction box 28. The band runs in contact with the inner band 32 but the linear speeds of the two bands are equal or almost equal.

The occurrence of sliding friction between the inner band 32 and the air box 28 does not give rise to difficulty because that inner supporting band does not have to be stretched. It is made from a material such that the band resists distortion by its running contact with the air box and can be much more resistant to surface wear than the conveying band 10.

The sliding friction between the conveying band and the inner band, which occurs because of the lateral stretching of the conveying band while the bands are drawn together by the action of the sub-atmospheric pressure in the air box, is of slight or negligible effect because the relative sliding movement occurs over only a small distance whose maximum, at the outer edges of the conveying band, is equal to $(b-a/2)$. At the centre of the conveying band it does not undergo any lateral displacement.

This sliding friction between the band occurs only in the stretching zone, in the inner reach of the conveyor. In the lower return reach there is no differential pressure causing increased contact pressure between the two bands. On the contrary, gravity tends to pull the return reach of the conveying band away from the corresponding reach of the inner band.

Wear of the inner band as a consequence of the lateral stretching of the conveying band is quite negligible.

The following data relate to one very satisfactory spreader-conveyor according to the present invention and its performance:

| | |
|---|---|
| Inlet width a of the conveying band: | 1450 mm |
| Outlet width b of the conveying band: | 1630 mm |
| Width of the inner band: | 1350 mm |
| Width (uniform) of the suction box: | 1400 mm |
| Length of the suction box: | 1300 mm |
| Length of the spreading zone: | 1680 mm |
| Sheet formats: | 5 rows of sheets of DIN A4 format, or 3 rows of sheets of DIN A3 format. |
| Transport speed: | 100 $m.min^{-1}$. |
| Air pressure difference produced by: the suction box on sheets lying on the conveying band | 20 pascal. |

A second embodiment of a spreader-conveyor in accordance with the invention is illustrated in FIG. 3. An endless conveying band 45 consisting of an elastically extensible air-permeable material is guided over four parallel rollers 46, 47, 48 and 49 and spread by means of two chain- and link mechanisms as shown in FIG. 1. An air-permeable non-extensible inner band 50 forms a loop within the loop of the band 45, and passes over a driving roller 51, guide rollers 52, 53, and 54, and a tensioning roller 55. The roller 55 may have a convex profile having a centering effect on the band 50. A centering action on the band 45 is not required because its lateral position is determined by the chain and link mechanisms.

A suction box 56 in which a subatmospheric pressure can be maintained, by means of fans 57, has a perforated upper wall that is in sliding contact with the band 50.

For the sake of clarity, the suction box 56, the band 50 and the band 45 have been drawn as if they were separated from each other, but in fact they run in contact with each other in their upper reaches under the influence of the air-pressure difference and of gravity.

The advantage of the apparatus according to FIG. 3 over the apparatus according to FIG. 1, is that in the FIG. 3 apparatus the speeds of the two endless bands can be individually controlled and thereby kept strictly equal. This speed equality may be difficult to achieve in the arrangement of FIG. 1 because of slipping of the band 32 which is driven by frictional contact with the band 10.

The invention is not limited to the described embodiments.

The inner band may have a width larger than the inlet width a of the spreader-conveyor and even as large as the outlet width b. The latter situation is preferred in the event that the suction box has a tapering shape e.g. so that its sides diverge like the edges of the conveying band. The use of a tapering air box enables the air-pressure difference to be established also at the diverging margins of the conveying band in order to improve the control of sheets in the outer rows on such band. If, when using such a tapering suction box, the inner band had a width only equal to a, the diverging margins of the conveying reach of the elastic conveyor band would run in contact with the box and this might cause excessive wear of such conveyor margins, particularly if the suction forces are relatively high.

The advantage of using a tapered air box depends upon the extent of divergence of the edges of the elastic conveying band over the spreading zone. If the divergence, i.e. the degree of lateral stretching of the band is small, so that the sheets of the outer rows on the conveying band on reaching the outlet end of the apparatus still have a substantial portion of their surface situated within the zone having the width a, then a box of rectangular shape with a width approximately equal to a will generally give satisfactory results.

The inner means which supports the conveying band where it passes over the air box may e.g. comprise two or more narrow endless and air-permeable bands that are positioned beside each other in order to cover the desired operative width, instead of a single endless band. In case there are used several narrow bands for the inner supporting means, such bands need not necessarily be arranged closely adjacent to each other. For instance, such bands may run between stationary lateral guides, e.g. in the form of elongated flat strips of unperforated metal, plastic, or the like, that may have a width equalling the width of the bands. In the mentioned way, a very good control of the lateral position of the bands may be obtained, whereas the air pressure difference is still effective to obtain the desired effect on the material supported on the conveyor.

The suction head may e.g. be formed by two or more boxes that are disposed beside or behind each other instead of a single air box. If the suction head comprises two or more boxes,different subatmospheric pressures may be maintained in different boxes.

I claim:

1. A conveyor for conveying and spreading material placed thereon, said conveyor comprising an endless air-permeable continuous conveying band adapted to travel through an endless path having a generally horizontal upper conveying stretch, said band being elastically extensible in its widthwise direction; driving mechanisms for said elastic band disposed along the opposite side edges thereof and connected to said side edges, said driving mechanisms moving in paths diverging from one another in the direction of travel of said elastic band; means for moving said driving mechanisms along said paths so as to cause successive portions of the elastic conveying band moving along said converging stretch to be progressively widthwise stretched; endless air-permeable supporting band means of nonextensible material mounted for travel through an endless path contained within the endless path of said elastic conveying band and having an upper stretch parallel to, generally coextensive with, and in close proximity to the upper stretch of said elastic conveying band so that said band and band means are in face to face contact within said stretches; and disposed inside the endless path of said supporting band means a suction head having a substantially open upper end extending beneath the upper reach of said supporting band means in close proximity to the underside thereof, said suction head being at least substantially coextensive widthwise with said elastic conveying band; and a source of subatmospheric pressure in communication with said vacuum head to maintain a sub-atmospheric pressure within said head, whereby material carried on said elastic conveying band is exposed to the sub-atmospheric pressure in said head through the air-permeable band and band means and is thereby urged against the contiguous surface of the conveying band during its travel through said conveying stretch.

2. A conveyor according to claim 1, wherein said supporting band is in the form of a continuous band having perforations.

3. A conveyor according to claim 1, wherein said suction head is in the form of a suction box having a top wall perforated throughout substantially its entire area with which said supporting band makes sliding contact.

4. A conveyor according to claim 1, wherein said two bands are in frictional contact sufficient to move the supporting band at substantially the same linear speed as said conveying band is driven.

5. A conveyor according to claim 1, wherein said conveying band and said supporting band are independently mounted and including separate drive means for said supporting band.

6. A conveyor according to claim 5, wherein the endless path of said supporting band is determined solely by guide rollers around which the same travels.

7. A conveyor according to claim 6, wherein at least one of said guide rollers is connectable to a driving means.

* * * * *